US010080423B1

(12) United States Patent
Bandlow et al.

(10) Patent No.: US 10,080,423 B1
(45) Date of Patent: Sep. 25, 2018

(54) QUICK RELEASE TIE DOWN STRAP

(71) Applicants: William Robert Bandlow, Gun Barrel City, TX (US); Robin L. Jaurez, Athens, TX (US)

(72) Inventors: William Robert Bandlow, Gun Barrel City, TX (US); Robin L. Jaurez, Athens, TX (US)

( * ) Notice: Subject to any disclaimer, the term of this patent is extended or adjusted under 35 U.S.C. 154(b) by 0 days.

(21) Appl. No.: 15/461,045

(22) Filed: Mar. 16, 2017

(51) Int. Cl.

| | |
|---|---|
| ***F16B 2/08*** | (2006.01) |
| ***F16B 1/00*** | (2006.01) |
| ***A44B 17/00*** | (2006.01) |
| ***A44B 18/00*** | (2006.01) |
| ***A45F 5/02*** | (2006.01) |
| ***F41C 33/02*** | (2006.01) |
| ***F41C 33/00*** | (2006.01) |

(52) U.S. Cl.
CPC ..... *A45F 5/02* (2013.01); *A44B 17/0064* (2013.01); *A44B 18/0073* (2013.01); *F41C 33/008* (2013.01); *F41C 33/0227* (2013.01); *A45F 2200/0591* (2013.01); *F41C 33/00* (2013.01); *Y10T 24/1397* (2015.01)

(58) Field of Classification Search
CPC ..... F41C 33/0227; A45F 5/02; A45F 2200/0591; Y10T 24/1382; Y10T 24/1388; Y10T 24/1397; Y10T 24/2708; A44B 17/0064; A44B 18/0069
See application file for complete search history.

(56) References Cited

U.S. PATENT DOCUMENTS

| | | | |
|---|---|---|---|
| 3,565,303 | A | 2/1971 | Kippen |
| 4,312,466 | A | 1/1982 | Clark |
| 4,466,537 | A | 8/1984 | McMahan |
| 4,544,089 | A | 10/1985 | Tabler |
| 4,562,945 | A | 1/1986 | Erlandson |
| 4,750,655 | A | 6/1988 | Barry |
| 5,201,447 | A | 4/1993 | Bumb |
| 5,215,238 | A | 6/1993 | Baruch |
| 5,236,113 | A | 8/1993 | Wisser |
| 5,246,153 | A | 9/1993 | Beletsky |
| 5,294,031 | A | 3/1994 | Volpei |
| 5,413,262 | A | 5/1995 | Dewire |
| 5,489,053 | A | 2/1996 | Davis |
| 5,678,686 | A | 10/1997 | Hagemann |
| 6,029,321 | A | 2/2000 | Fisher |
| 6,138,882 | A | 10/2000 | Buettner |
| 6,874,628 | B2 | 4/2005 | Hammill |
| 8,225,976 | B2 | 7/2012 | Meunier |
| 9,211,985 | B2 | 12/2015 | Milani |
| 2003/0034366 | A1 | 2/2003 | Sloan |
| 2006/0117465 | A1 | 6/2006 | Willows |
| 2012/0181311 | A1 | 7/2012 | Stevens |

(Continued)

*Primary Examiner* — Robert Sandy
(74) *Attorney, Agent, or Firm* — Quickpatents, LLC; Kevin Prince

(57) ABSTRACT

A strap system is disclosed that has elongated primary and secondary straps, each having top and bottom sides, front and rear ends, and peripheral edges. The top side of the primary strap includes a first two-part mechanical fastener. The front end of the bottom side of the primary strap has a first part of a second two-part mechanical fastener, from which a stiffener extends forward. The bottom side of the secondary strap is fixed with the second object. The secondary strap also includes at the front end of the bottom side a second part of the second two-part mechanical fastener, and includes at the rear end a loop fixed about a rigid ring.

13 Claims, 5 Drawing Sheets

(56) References Cited

U.S. PATENT DOCUMENTS

| | | | |
|---|---|---|---|
| 2014/0144076 | A1 | 5/2014 | Deeb |
| 2014/0151411 | A1 | 6/2014 | Anderson |
| 2014/0151413 | A1 | 6/2014 | Ponder |
| 2014/0183234 | A1 | 7/2014 | Hudspeth |

QUICK RELEASE TIE DOWN STRAP

CROSS-REFERENCE TO RELATED APPLICATIONS

Not Applicable.

STATEMENT REGARDING FEDERALLY SPONSORED RESEARCH AND DEVELOPMENT

Not Applicable.

FIELD OF THE INVENTION

This invention relates to storage and transportation equipment for weapons, tools, and other hand-held and hand-operated items (including but not limited to: short- and long-guns; knives; collapsible tripods; sports equipment; military equipment; and power tools), and more particularly to a modular, customizable, and easily adjustable quick-release strap system for securing such an item to an object for storage or transport while still allowing for swift removal of the item therefrom, enabling the user to effortlessly retrieve and bring the item into use in moments of immediate need and minimizing any potentially dangerous or disadvantageous delay.

BACKGROUND

This invention relates to storage and transportation equipment for weapons, tools, and other hand-held and hand-operated items (including but not limited to: short- and long-guns; knives; collapsible tripods; sports equipment; military equipment; and power tools), and more particularly to a modular, customizable, and easily adjustable quick-release strap system for securing such an item to the rigidly reinforced surface of a suitable storage or transport vessel while still allowing for swift removal of the item, enabling the user to effortlessly retrieve and bring the item into use in moments of immediate need and minimizing any potentially dangerous or disadvantageous delay. The prior art includes: U.S. Pat. No. 5,246,153 (Sep. 21, 1993); U.S. Pat. No. 5,215,238 (Jun. 1, 1993); U.S. Pat. No. 5,201,447 (Apr. 13, 1993); U.S. Pat. No. 4,312,466 (Jan. 26, 1982); U.S. Pat. No. 6,029,321 (Feb. 29, 2000); and U.S. Pat. No. 6,138,882 (Oct. 31, 2000). It is desirable to have an improved quick-release strap system that is superior to any that is disclosed or suggested in the identified references.

SUMMARY OF THE INVENTION

The present device is a strap system for use to securely restrain a first object against a second object. The strap system comprises: an elongated primary strap having a top side, a bottom side, a front end, a rear end, and a peripheral edge. The primary strap includes at fastener. The top side of the primary strap also includes a second part of the first two-part mechanical fastener. In some preferred embodiments, the first two-part mechanical fastener is a hook-and-loop type fastener. The primary strap further includes at the bottom side, proximate the front end thereof, a first part of a second two-part mechanical fastener and a stiffener that extends forward from the first part of the second two-part mechanical fastener. In some preferred embodiments, the second two-part mechanical fastener is a mechanical snap.

In additional preferred embodiments, the stiffener and the front end of the primary strap extend at least 0.5 inches beyond the first part of the second two-part mechanical fastener.

The strap system further comprises an elongated secondary strap having a top side, a bottom side, a front end, a rear end, and a peripheral edge. The bottom side of the secondary strap is fixed with the second object. In some preferred embodiments, the secondary strap is affixed with the second object by a stitched thread. In alternate preferred embodiments, the secondary strap is affixed with the second object with a third two-part mechanical fastener. The secondary strap also includes at the bottom side, proximate the front end thereof, a second part of the second two-part mechanical fastener. Additionally, the rear end of the secondary strap includes a loop fixed about a rigid ring.

When the first two-part mechanical fastener is the hook-and-loop type fastener, in some preferred embodiments the primary strap is a length of the first part of the hook-and-loop type fastener having a smaller length of the second part of the hook-and-loop type fastener fixer thereto at the rear end of the top side of the primary strap. In this configuration, the stiffener is fixed between the front end of the primary strap folded over itself. This configuration is referred to herein as the "folded over hook-and-loop configuration." In some preferred embodiments implementing the folded over hook-and-loop configuration, the second two-part mechanical fastener is the mechanical snap. In certain preferred embodiments implementing the folded over hook-and-loop configuration, the first part of the first two-part mechanical fastener is either a loop-part or a hook-part of the hook-and-loop type fastener, and the second part of the first two-part mechanical fastener is the corresponding hook-part or the corresponding loop-part of the hook-and-loop type fastener.

In preferred embodiments where the secondary strap is affixed with the second object with the third two-part mechanical fastener, optionally the third two-part mechanical fastener is the hook-and-loop type fastener, with a first part of the third two-part mechanical fastener being fixed with the second object and with a second part of the third two-part mechanical fastener being fixed with the bottom side of the secondary strap.

In use, the secondary strap is affixed to the second object, and the rear end of the primary strap and the rear end of the secondary strap are affixed mutually together about the rigid ring with the first two-part mechanical fastener. The first object is then placed against the secondary strap while the primary strap is affixed to the secondary strap with the second two-part mechanical fastener. This securely restrains the first object against the second object.

The present invention is a highly modular, customizable, and easily adjustable device suitable for storing a wide variety of hand-held and hand-operated items securely against the surface of any storage or transport vessel which is able to be rigidly reinforced. It facilitates not only quick storage of such items, but also the retrieval and deployment into use of such items with great speed and minimal effort. This immensely benefits the user in situations where there is an immediate, perhaps even emergency, need for the item or where a delay in deployment might otherwise be dangerous or disadvantageous.

The invention is also superior to thumb-break mechanisms previously used to restrain such items on or in such storage or transport objects or vessels. It not only allows for swifter, easier deployment than thumb-breaks (which often require a significant and distracting amount of both force and time to operate and may even snag and prevent deployment entirely until fixed), but also eliminates the known risk of damage to stored items in close proximity to a thumb-break which is being actively manipulated by a user. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element. Finally, "Detailed Description" refers to this Detailed Description of the Preferred Embodiment.

Figure 1:
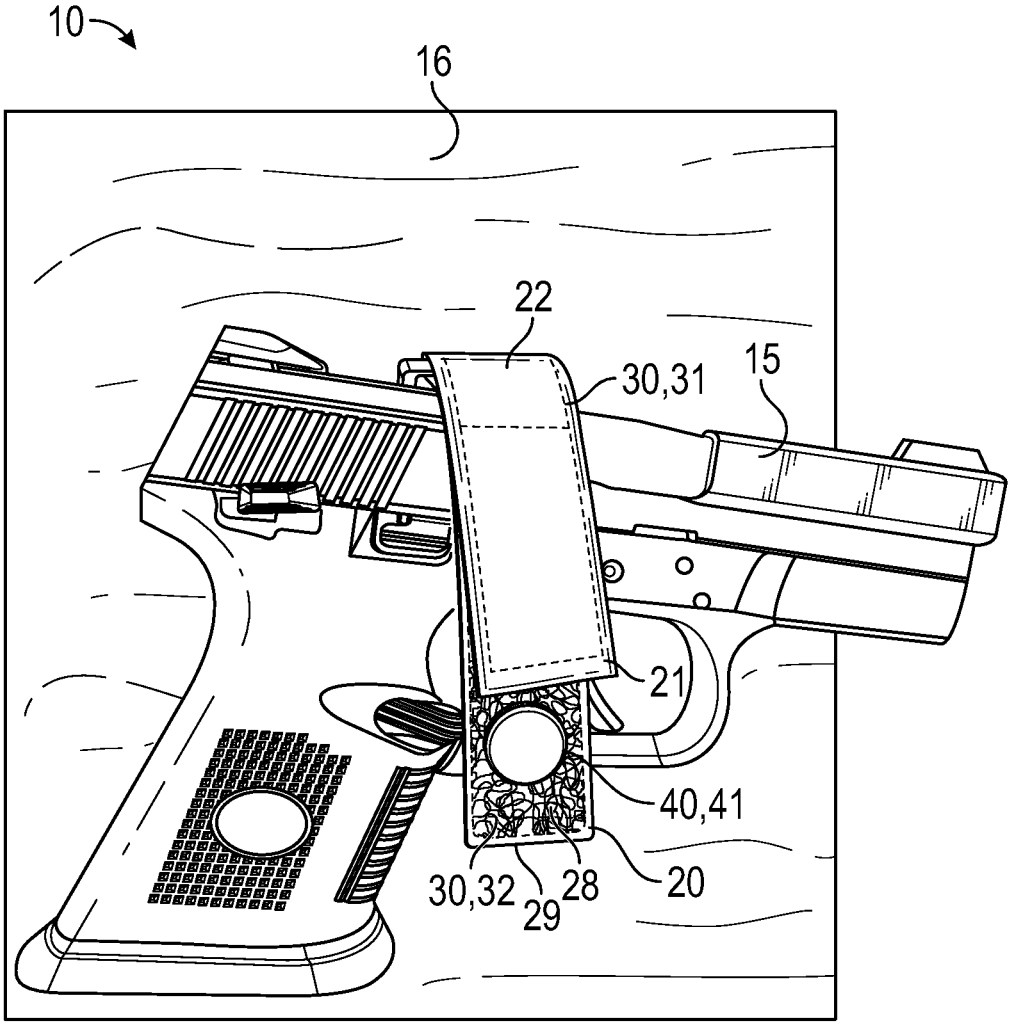
FIG. 1 is a side perspective view of one embodiment of the invention, shown configured for use with a handgun.
Figure 2:
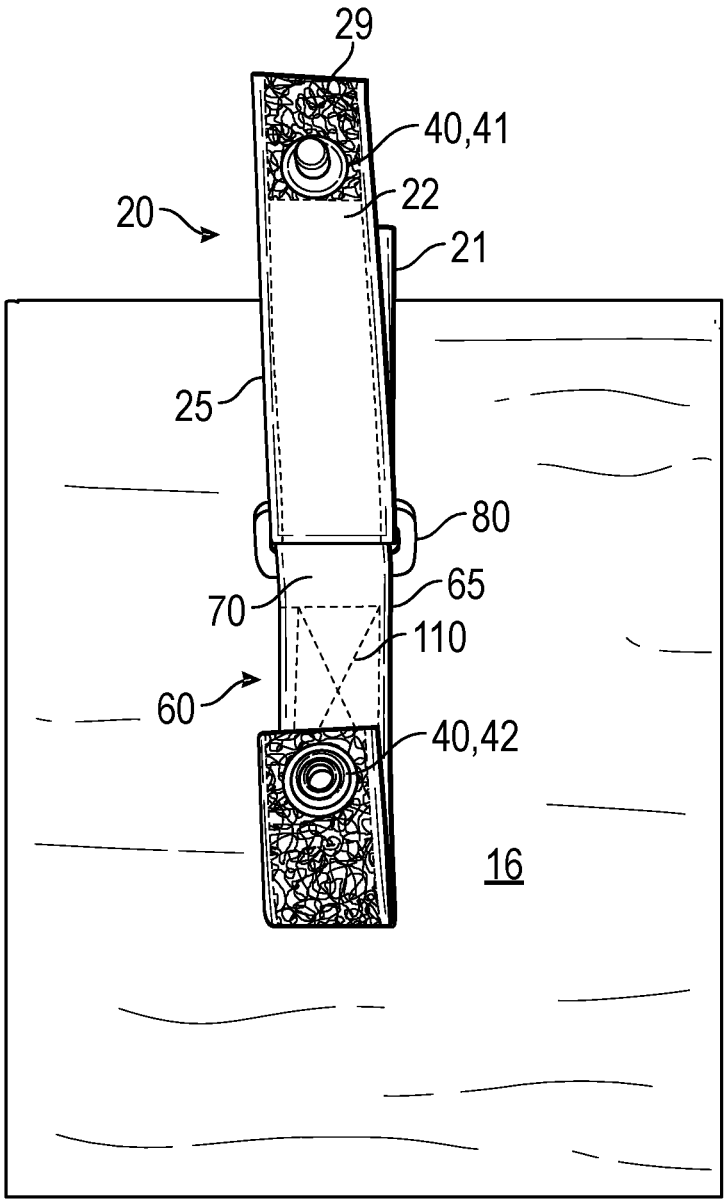
FIG. 2 is a side perspective view of the invention, shown empty with the primary strap and secondary strap open and ready to receive and restrain an item.
Figure 3:
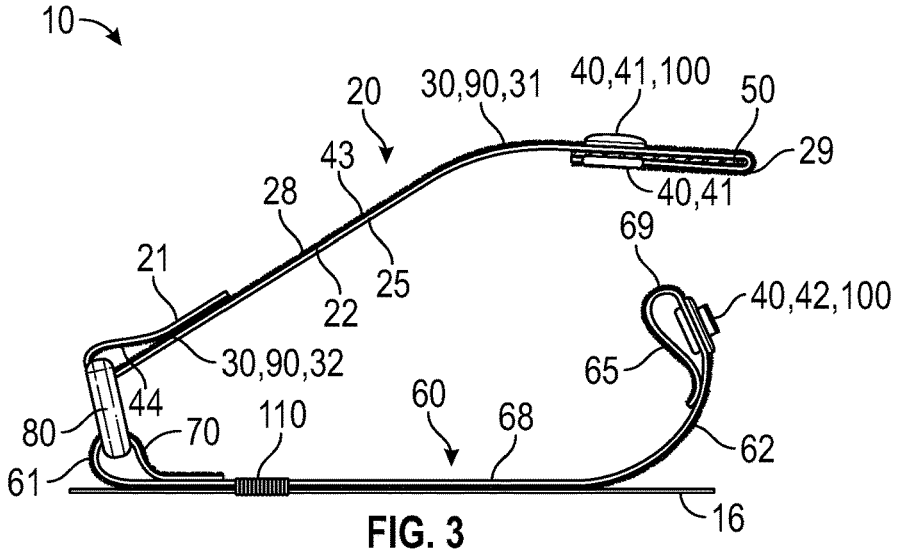
FIG. 3 is a side elevational view of the invention.
Figure 4:
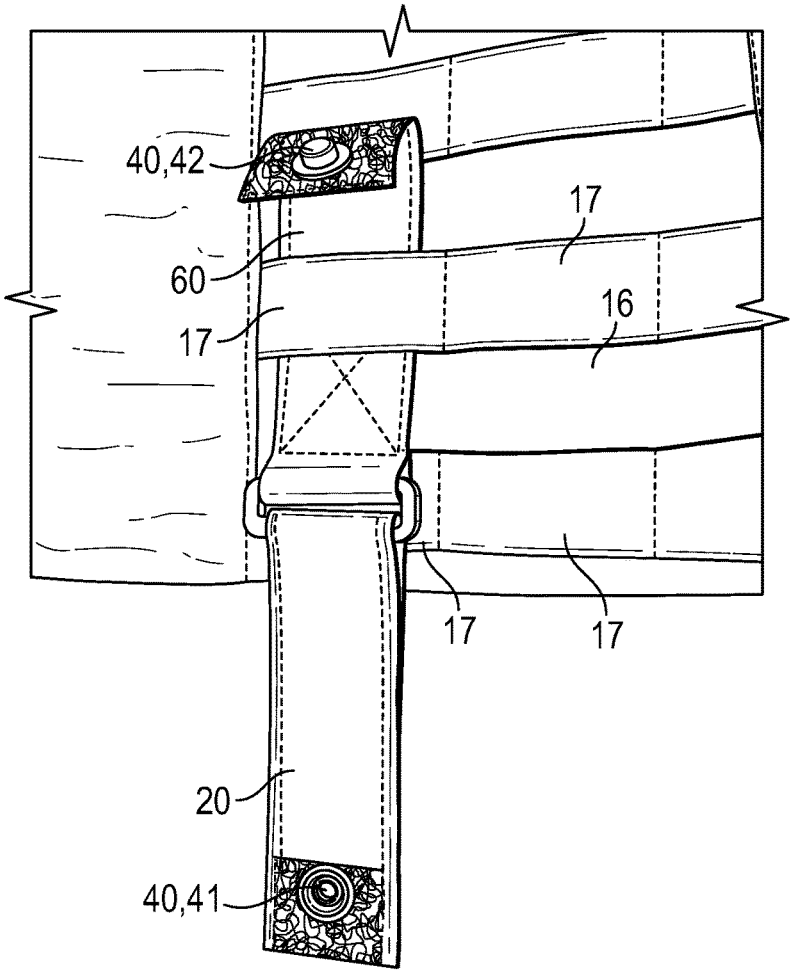
FIG. 4 is a partial front perspective view of the invention, shown configured for use with a MOLLE strap system.

FIGS. 1-6 illustrate a strap system 10 for use to securely restrain a first object 15 (FIG. 1) against a second object 16. The first object 15 may be any of a wide variety of weapons, tools, and other hand-held and hand-operated items (including but not limited to: short- and long-guns; knives; collapsible tripods; sports equipment; military equipment; and power tools). The second object 16 may be any of a wide variety of clothing; cases; racks; or any other use-case suitable storage or transport object 16 featuring a surface appropriate for mounting the strap system 10 upon. The strap system 10 comprises: an elongated primary strap 20 having a top side 28 (FIGS. 1, 3), a bottom side 22 (FIGS. 1-3), a front end 29 (FIGS. 1-3), a rear end 21 (FIGS. 1-3), and a peripheral edge 25 (FIGS. 2, 3). The primary strap 20 (FIGS. 1-5) includes at the top side 28, proximate the rear end 21 thereof, a first part 31 (FIGS. 1, 3) of a first two-part mechanical fastener 30 (FIGS. 1, 3). The top side 28 of the primary strap 20 also includes a second part 32 (FIGS. 1, 3) of the first two-part mechanical fastener 30. In some preferred embodiments, the first two-part mechanical fastener 30 is a hook-and-loop type fastener 90 (FIG. 3), which may be made of VELCRO® or any mechanically similar material. The primary strap 20 further includes at the bottom side 22, proximate the front end 29 thereof, a first part 41 (FIGS. 1-4) of a second two-part mechanical fastener 40 (FIGS. 1-4), and also a stiffener 50 (FIG. 3), such as a length of resilient plastic sheet material or the like, that extends forward from the first part 41 of the second two-part mechanical fastener 40. In some preferred embodiments, the second two-part mechanical fastener 40 is a mechanical snap 100 (FIG. 3). The mechanical snap 100 may be either post-style, prong-style, or any other mechanically similar implementation. In additional preferred embodiments, the stiffener 50 and the front end 29 of the primary strap 20 extend at least 0.5 inches beyond the first part 41 of the second two-part mechanical fastener 40.

Figure 5:
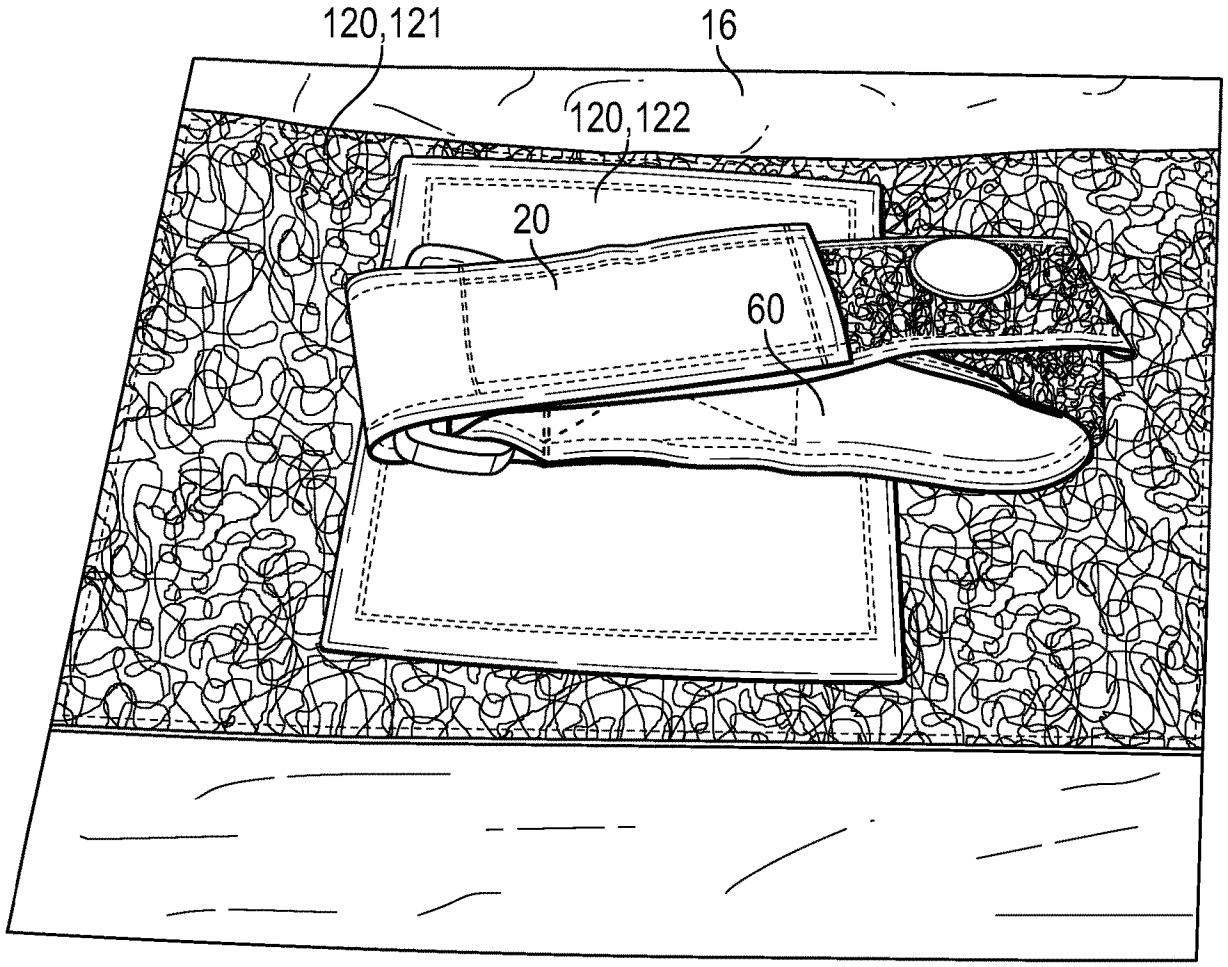
FIG. 5 is a top perspective view of the invention, shown with the primary strap and the secondary strap configured to attach to each other at a third two-part mechanical fastener.
Figure 6:
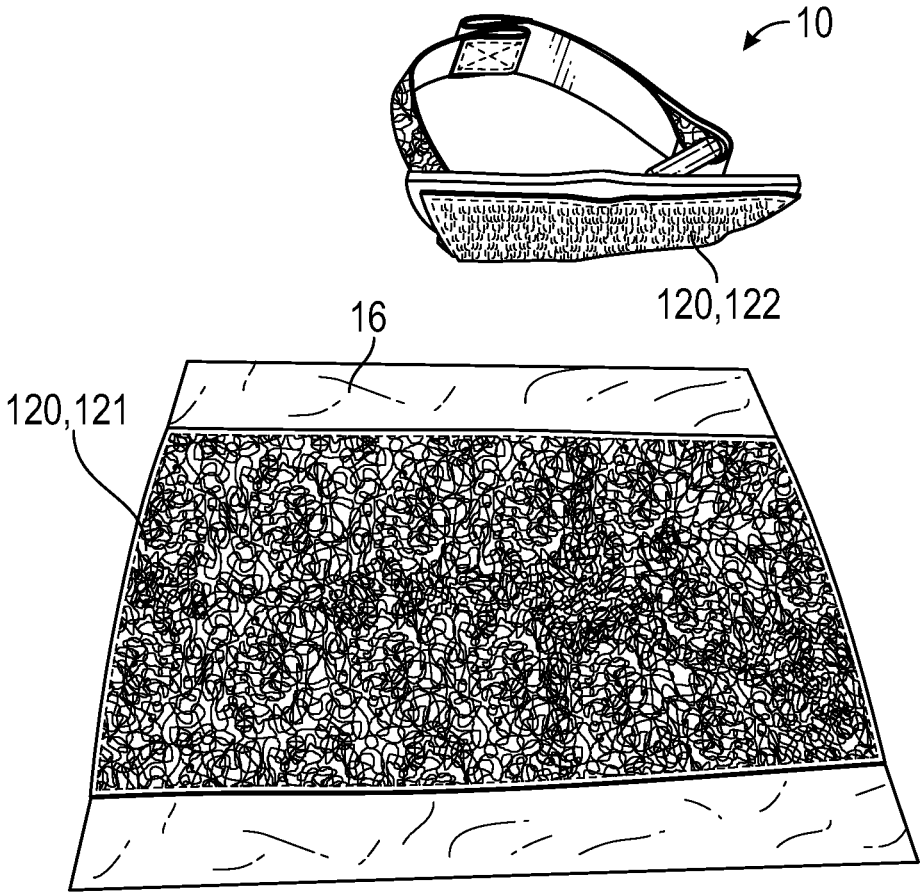
FIG. 6 is a side perspective view of the embodiment of the invention shown in FIG. 5, shown with the third two-part mechanical fastener configured to use a hook and-loop fastener.

The strap system 10 further comprises an elongated secondary strap 60 (FIGS. 2-5) having a top side 68 (FIG. 3), a bottom side 62 (FIG. 3), a front end 69 (FIG. 3), a rear end 61 (FIG. 3), and a peripheral edge 65 (FIGS. 2-3). The bottom side 62 of the secondary strap 60 is fixed with the second object 16. In some preferred embodiments, the secondary strap 60 is affixed with the second object 16 by a stitched thread 110 (FIG. 3). In other preferred embodiments, the secondary strap 60 is affixed with the second object 16 by threading of the secondary strap 60 through one of a plurality of MOLLE straps 17 (FIG. 4) (Modular Lightweight Load-Carrying Equipment straps) of the second object 16. The MOLLE straps 17 may be those specifically manufactured by Specialty Defense Systems or any other load bearing systems or subsystems utilizing woven PALS (Pouch Attachment Ladder System) webbing for modular pouch or item attachment. In alternate preferred embodiments, the secondary strap 60 is affixed with the second object 16 with a third two-part mechanical fastener 120 (FIGS. 5-6). The secondary strap 60 also includes at the bottom side 62, proximate the front end 69 thereof, a second part 42 (FIGS. 2-4) of the second two-part mechanical fastener 40. Additionally, the rear end 61 of the secondary strap 60 includes a loop 70 (FIGS. 2-3) fixed about a rigid ring 80 (FIGS. 2-3). The rigid ring 80 may be made from metal; thermoplastic; or any other sufficiently rigid, non-brittle material that is designed for long-term use and is intended to withstand the stresses of holding items of potentially considerable weight in place without deforming or otherwise losing structural integrity.

Both the primary strap 20 and the secondary strap 60 may be manufactured from any of (or a combination of any of) a variety of materials suited and safe for repeated, long-term use in the storage and transport of the first objects 15 that the strap system 10 is intended to restrain. Such materials include but are not limited to: GORE-TEX® and mechanically similar products; nylon, various ballistic fabrics, and mechanically similar products; natural leather and synthetic substitutes (e.g.: vinyl); polyester and mechanically similar material; bungee cords/shock cords and other mechanically similar elastic/elastomers; thermoplastics and other mechanically similar materials; and other suitable natural and synthetic fibers.

When the first two-part mechanical fastener 30 is the hook-and-loop type fastener 90, in some preferred embodiments the primary strap 20 is a length of the first part of the hook-and-loop type fastener 90 having a smaller length of the second part of the hook-and-loop type fastener 90 fixed thereto at the rear end 21 of the top side 28 of the primary strap 20. In this configuration, the stiffener 50 is fixed between the front end 29 of the primary strap 20 folded over itself. This configuration is referred to herein as the "folded over hook-and-loop configuration." In some preferred embodiments implementing the folded over hook-and-loop configuration, the second two-part mechanical fastener 40 is the mechanical snap 100. In certain preferred embodiments implementing the folded over hook-and-loop configuration, the first part 31 of the first two-part mechanical fastener 30 is either a loop-part 43 (FIG. 3) or a hook-part 44 (FIG. 3) of the hook-and-loop type fastener 90, and the second part 32 of the first two-part mechanical fastener 30 is the corresponding hook-part 44 or the corresponding loop-part 43 of the hook-and-loop type fastener 90.

In preferred embodiments where the secondary strap 60 is affixed with the second object 16 with the third two-part mechanical fastener 120, optionally the third two-part mechanical fastener 120 is the hook-and-loop type fastener 90, with a first part 121 (FIGS. 5-6) of the third two-part mechanical fastener 120 being fixed with the second object 16 and with a second part 122 (FIGS. 5-6) of the third two-part mechanical fastener 120 being fixed with the bottom side 62 of the secondary strap 60. In such embodiments, the secondary strap 60 may optionally be affixed with the second part 122 of the third two-part mechanical fastener 120 with the stitched thread 110.

In use, the secondary strap 60 is affixed to the second object 16, and the rear end 21 of the primary strap 20 and the rear end 61 of the secondary strap 60 are affixed mutually together about the rigid ring 80 with the first two-part mechanical fastener 30. The first object 15 is then placed against the secondary strap 60 while the primary strap 20 is affixed to the secondary strap 60 with the second two-part mechanical fastener 40. This securely restrains the first object 15 against the second object 16.

While a particular form of the invention has been illustrated and described, it will be apparent that various modifications can be made without departing from the spirit and scope of the invention. For example, the stiffener 50 may be made of any sufficiently rigid, non-brittle material that is designed for long-term use and is intended to withstand the stresses of holding items of potentially considerable weight in place without deforming or otherwise losing structural integrity. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above Detailed Description. While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A strap system for securing a first object to a second object, comprising:

an elongated primary strap having a top side, a bottom side, a front end, a rear end, and a peripheral edge, the primary strap including at the top side proximate the rear end thereof a first part of a first two-part mechanical fastener, the top side of the primary strap further including a second part of the first two-part mechanical fastener, the primary strap further including at the bottom side proximate the front end thereof a first part of a second two-part mechanical fastener and a stiffener that extends forward from the first part of the second two-part mechanical fastener; and an elongated secondary strap having a top side, a bottom side, a front end, a rear end, and a peripheral edge, the bottom side fixed with the second object, the secondary strap including at the top bottom side proximate the front end thereof a second part of the second two-part mechanical fastener, the rear end of the secondary strap including a loop fixed about a rigid ring;

whereby with the secondary strap affixed to the second object, and with the rear end of the primary strap affixed about the rigid ring, the first object can be placed against the secondary strap while the primary strap is affixed to the secondary strap and the second two-part mechanical fasteners.

2. The strap system of claim 1 wherein the first two-part mechanical fastener is a hook-and-loop type fastener.

3. The strap system of claim 2 wherein the primary strap is a length of the first part of the hook-and-loop type fastener having a smaller length of the second part of the hook-and-loop type fastener fixed thereto at the rear end of the top side of the primary strap, and wherein the stiffener is fixed between the front end of the primary strap folded over itself.

4. The strap system of claim 3 wherein the second two-part mechanical fastener is a mechanical snap.

5. The strap system of claim 3 wherein the first part of the first two-part mechanical fastener is the loop-part of the hook-and-loop type fastener, and wherein the second part of the first two-part mechanical fastener is the hook-part of the hook-and-loop type fastener.

6. The strap system of claim 3 wherein the first part of the first two-part mechanical fastener is a hook-part of the hook-and-loop type fastener, and wherein the second part of the first two-part mechanical fastener is a loop-part of the hook-and-loop type fastener.

7. The strap system of claim 1 wherein the second two-part mechanical fastener is a mechanical snap.

8. The strap system of claim 1 wherein the secondary strap is affixed with the second object by a stitched thread.

9. The strap system of claim 1 wherein the secondary strap is affixed with the second object by threading of the secondary strap through one of a plurality of MOLLE straps of the second object.

10. The strap system of claim 1 wherein the secondary strap is affixed with the second object with a third two-part mechanical fastener.

11. The strap system of claim 10 wherein the third two-part mechanical fastener is a hook-and-loop type mechanical fastener, with a first part of the third two-part mechanical fastener being fixed with the object and with a second part of the third two-part mechanical fastener being fixed with the bottom side of the secondary strap.

12. The strap system of claim 11 wherein the secondary strap is affixed with the second part of the third two-part mechanical fastener with a stitched thread.

13. The strap system of claim 1 wherein the stiffener and front end of the primary strap extend at least 0.5 inches beyond the first part of the second two-part mechanical fastener.

* * * * *